US012606401B2

(12) United States Patent
Feix et al.

(10) Patent No.: US 12,606,401 B2
(45) Date of Patent: Apr. 21, 2026

(54) ROTARY STORAGE SYSTEM

(71) Applicant: CreateMe Technologies Inc., Newark, CA (US)

(72) Inventors: Thomas Feix, Beaverton, OR (US); Nicholas D. Chope, Portland, OR (US)

(73) Assignee: CreateMe Technologies Inc., Newark, CA (US)

( * ) Notice: Subject to any disclaimer, the term of this patent is extended or adjusted under 35 U.S.C. 154(b) by 0 days.

(21) Appl. No.: 19/056,175

(22) Filed: Feb. 18, 2025

(65) Prior Publication Data

US 2026/0021991 A1 Jan. 22, 2026

Related U.S. Application Data

(63) Continuation of application No. 18/774,193, filed on Jul. 16, 2024, now Pat. No. 12,351,411.

(51) Int. Cl.

| | |
|---|---|
| ***B65H 18/08*** | (2006.01) |
| ***B65H 18/14*** | (2006.01) |
| ***B65H 29/00*** | (2006.01) |
| ***B65H 29/24*** | (2006.01) |
| ***B65H 39/14*** | (2006.01) |

(52) U.S. Cl.

CPC ..... *B65H 29/006* (2013.01); *B65H 18/145* (2013.01); *B65H 29/241* (2013.01); *B65H 39/14* (2013.01); *B65H 2301/4191* (2013.01); *B65H 2408/2321* (2013.01); *B65H 2511/512* (2013.01); *B65H 2701/124* (2013.01)

(58) Field of Classification Search

CPC ..... B07C 3/18; B65H 29/006; B65H 29/241; B65H 18/08; B65H 18/145; B65H 39/14; B65H 2301/519; B65H 2301/4191; B65H 2408/2321; B65H 2511/512; B65H 2701/124; B65H 2701/12422

USPC ..... 270/52.02

See application file for complete search history.

(56) References Cited

U.S. PATENT DOCUMENTS

| | | | | |
|---|---|---|---|---|
| 4,225,129 | A * | 9/1980 | Zimmermann | B65H 29/041 271/204 |
| 5,608,639 | A * | 3/1997 | Twardowski | B65H 39/02 700/125 |
| 8,256,604 | B2 * | 9/2012 | Ohishi | G07D 11/50 194/206 |
| 11,668,656 | B1 | 6/2023 | Myers | |
| 11,793,258 | B1 * | 10/2023 | Chope | A41H 42/00 |
| 11,969,981 | B2 * | 4/2024 | Chope | B32B 37/18 |

* cited by examiner

*Primary Examiner* — Leslie A Nicholson, III

(74) *Attorney, Agent, or Firm* — Moore Intellectual Property Law, PLLC

(57) ABSTRACT

A rotary storage device includes a body and a transfer material. The transfer material includes a first end coupled to the body, a second end opposite the first end, and a transfer material length between the first end and the second end. The transfer material length is wound around the body for an entirety of the transfer material length. The rotary storage device also includes a plurality of manufactured items disposed in a singulated manner along the transfer material length. Each of the plurality of manufactured items is removable from the transfer material.

20 Claims, 4 Drawing Sheets

ROTARY STORAGE SYSTEM

RELATED APPLICATION

This application is a continuation application of U.S. application Ser. No. 18/774,193, entitled "Rotary Storage System," filed Jul. 16, 2024, the entire contents of which are incorporated herein by reference.

FIELD OF THE DISCLOSURE

The present disclosure is generally related to apparatus, systems, and methods for a rotary storage system for manufactured items, including fabric items such as garments.

BACKGROUND

Despite technological advances and the introduction of automation in many types of manufacturing, the manufacturing of fabric items, such as garments, remains very labor-intensive. The process of producing large quantities of ready-to-wear apparel relies heavily on manual labor and remains inefficient relative to other industrial manufacturing processes. Garment manufacturing includes multiple steps including sizing, folding, fitting, cutting, sewing, and material handling. The unique and varied properties of individual fabrics, such as weight, thickness, strength, stretch, and drape, as well as the complex nature of certain tasks, complicates material handling and automated garment manufacturing.

As automation techniques in garment manufacturing improve, a corresponding need arises for a storage system for manufactured items to support improved automated systems for manufacturing fabric items. Certain existing storage systems do not allow for improved manufacturing efficiency, particularly in storage of singulated manufactured fabric items.

SUMMARY

In a particular implementation, a rotary storage device can include a body and a transfer material. The transfer material can include a first end coupled to the body, a second end opposite the first end, and a transfer material length between the first end and the second end. The transfer material length is wound around the body for an entirety of the transfer material length. The rotary storage device can also include a plurality of manufactured items disposed in a singulated manner along the transfer material length. Each of the plurality of manufactured items is removable from the transfer material.

In another particular implementation, a system can include a rotary storage device including a first body. The system can include a transfer material. The transfer material includes a first end configured to be coupled to the first body, a second end opposite the first end and configured to be coupled to a second body, a transfer material length between the first end and the second end, and a plurality of manufactured items disposed in a singulated manner along the transfer material length. Each of the plurality of manufactured items is removable from the transfer material. The system can also include a manufactured item support surface disposed between the first and second bodies, wherein the manufactured item support surface is configured to support each of the plurality of manufactured items during singulated removal of the plurality of manufactured items from the transfer material.

In another particular implementation, a method can include unspooling a transfer material from a first body. A plurality of manufactured items are disposed in a singulated manner along the transfer material. The method also includes, while the transfer material is unspooling from the first body, spooling the transfer material on a second body. The method also includes performing a subsequent manufacturing operation on each of the plurality of manufactured items while the transfer material is moving from the first body to the second body.

The features, functions, and advantages described herein can be achieved independently in various implementations or may be combined in yet other implementations, further details of which can be found with reference to the following description and drawings.

DETAILED DESCRIPTION

Figure 1A:
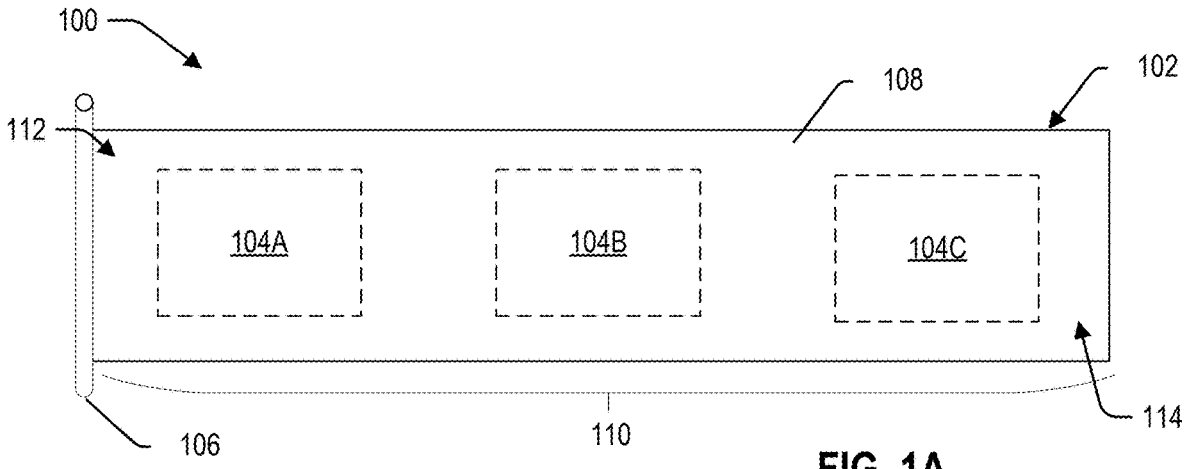
FIG. 1A illustrates an example rotary storage device in a first state, in accordance with some examples of the subject disclosure.

Aspects disclosed herein present systems, apparatus, and methods for joining fabric items. Traditional manufacturing of fabric items is labor intensive and uses sewing machines, which were invented in the early nineteenth century. The laborers using these sewing machines manufactured fabric items by using the lock stitch sewing technique.

Today this same technology remains the foundation of fabric item manufacturing. The modern process of producing large quantities of ready-to-wear fabric items relies heavily on manual labor and remains inefficient relative to other industrial manufacturing processes. The manufacturing of fabric items includes multiple steps including, but not limited to, sizing, folding, fitting, cutting, sewing, and material handling. The unique and varied properties of individual fabrics, such as weight, thickness, strength, stretch, and drape, as well as the complex nature of certain tasks, complicates material handling and automated fabric item manufacturing.

In most small and large fabric item manufacturing factories, most of the material handling and fabric item manufacturing operations are conducted in a manual or semimanual manner. The fabric item manufacturing process may start with laying out a web of fabric for multiple hours to relax the fabric and remove wrinkles. Then, one or more layers of fabric may be cut based on patterns and dimensions matching the desired fabric item. Then, the cut fabric pieces are transferred from workstation to workstation, where at each workstation, one, two, or more pieces of fabrics are manually folded, overlapped along the seams, and fed into a sewing machine or serger machine (also referred to as an overlock machine). In addition, at these workstations one or more folds may create an unnecessary crease in the fabric, which will increase the amount of time to manufacture the fabric item as the crease will need to be removed.

Given the variety of fabrics, threads, seam types, and stitch types found in a finished garment, a large number of workstations with specialized tools and skilled operators may be required for assembling a fabric item. This results in fabrics or unfinished fabric items spending time in transit between workstations, which adversely affects the time required to complete a fabric item. Thus, traditional apparel manufacturing operations may include multiple sequential processes. Further, a time constant may be required between each operation to allow the fabric to relax or remove unnecessary creases, which further increases the time required to process a fabric item.

Accordingly, there is a need for an automated system for manufacturing fabric items to improve manufacturing efficiency and variation reduction between individual manufactured fabric items. Additionally, there is a need for a storage system that allows for greater automation in efficiency in storing manufactured items between manufacturing processing, whether for further manufacturing, storage, distribution etc. In order to increase efficiency, the storage system should enable individual manufactured items to be stored in a manner that allows for singulated storage and retrieval.

Described in this disclosure are techniques and systems for manufacturing a fabric item that improves manufacturing efficiency through improved manufactured item storage. The rotary storage device disclosed herein can include a body and a transfer material. The transfer material can include a first end coupled to the body, a second end opposite the first end, and a transfer material length between the first end and the second end. The transfer material length can be wound around the body for an entirety of the transfer material length. A plurality of manufactured items are disposed in a singulated manner along the transfer material length, with each of the plurality of manufactured items being removable from the transfer material. Being a rotary storage system, the systems and methods disclosed herein allow for the spooling and unspooling of the transfer material, presenting the singulated manufactured items to an automated manufacturing system an item at a time for subsequent processing. This can enable improved automation of a fabric manufacturing system both within a single manufacturing location as well as across a distributed manufacturing system.

The fabric manufacturing system can also include, for example, a manufactured item support surface disposed between a first body coupled to the first end of the transfer material and a second body coupled to the second end of the transfer material. The manufactured item support surface can be configured to support each of the plurality of manufactured items during singulated removal of the manufactured items from the transfer material.

Subsequent manufacturing processes can include item marking, folding the fabric item, applying adhesive, and curing the adhesive. For example, a completed fabric item may include, but is not limited to, a garment (e.g. a shirt, pants, socks, shoes, shorts, a coat, a jacket, a skirt, a dress, an undergarment, a hat, a headband, and the like), an accessory (e.g. a wallet, a purse, and the like), and homeware (e.g. artwork, upholstery, a towel, a bed linen, a blanket, a mat, and the like). Each component of a completed fabric item can also be marked (e.g., with a bar code, QR code, other appropriate identifier, etc.), whether for use in the final completed fabric item or as a means of tracking components during subsequent manufacturing processes.

By using the techniques and systems described herein, the manufacturing efficiency for manufacturing a fabric item may improve because fabric item components can be stored efficiently and in an automated manner, as well as retrieved in an efficient and automated manner in other manufacturing processes such as folding the fabric item, applying adhesive, and curing the adhesive. This can be particularly useful, for example, in moving fabric item components from a cutting location to a folding/adhering location. Manufacturing efficiency can also be improved by enabling the incorporation of the storage system into the manufacturing system itself. The rotary storage system described herein can be incorporated into an overall manufacturing system, allowing for the simultaneous unspooling—presenting singulated manufactured items for processing—and spooling—preparing the transfer material for receipt of additional manufactured items.

The figures and the following description illustrate specific exemplary implementations. It will be appreciated that those skilled in the art will be able to devise various arrangements that, although not explicitly described or shown herein, embody the principles described herein and are included within the scope of the claims that follow this description. Furthermore, any examples described herein are intended to aid in understanding the principles of the disclosure and are to be construed as being without limitation. As a result, this disclosure is not limited to the specific implementations or examples described below, but by the claims and their equivalents.

Particular implementations are described herein with reference to the drawings. In the description, common features are designated by common reference numbers throughout the drawings. In some drawings, multiple instances of a particular type of feature are used. Although these features are physically and/or logically distinct, the same reference number is used for each, and the different instances are distinguished by addition of a letter to the reference number. When the features as a group or a type are referred to herein (e.g., when no particular one of the features is being referenced), the reference number is used without a distinguishing letter. However, when one particular feature of multiple features of the same type is referred to herein, the reference number is used with the distinguishing letter. For example, referring to FIG. 1A, multiple manufactured items are illustrated and associated with reference numbers 104A, 104B, and 104C. When referring to a particular one of these manufactured items, such as the first manufactured item 104A, the distinguishing letter "A" is used. However, when referring to any arbitrary one of these sections or to these sections as a group, the reference number 104 is used without a distinguishing letter.

Figure 2:
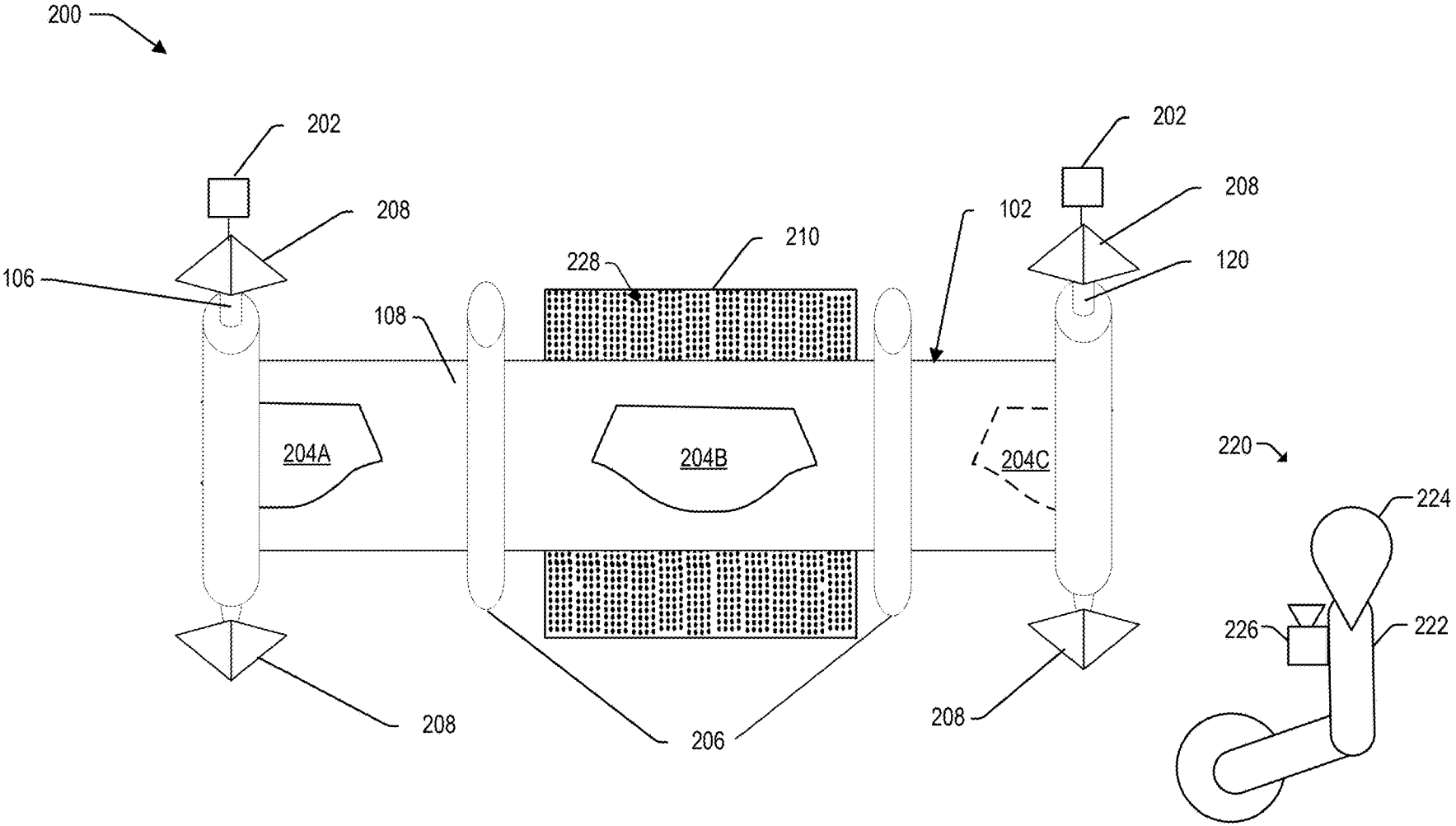
FIG. 2 illustrates an example system including the rotary storage device supporting a manufactured item during a subsequent manufacturing operation, in accordance with some examples of the subject disclosure.

As used herein, various terminology is used for the purpose of describing particular implementations only and is not intended to be limiting. For example, the singular forms "a," "an," and "the" are intended to include the plural forms as well, unless the context clearly indicates otherwise. Further, some features described herein are singular in some implementations and plural in other implementations. To illustrate, FIG. 2 depicts a system 200 including one or more rotary storage system couplers 208. In some implementations, the system 200 includes a single rotary storage system coupler 208 and in other implementations the system 200 includes multiple rotary storage system couplers 208. For ease of reference herein, such features are generally introduced as "one or more" features and are subsequently referred to in the singular or optional plural (as typically indicated by "(s)") unless aspects related to multiple of the features are being described.

The terms "comprise," "comprises," and "comprising" are used interchangeably with "include," "includes," or "including." Additionally, the term "wherein" is used interchangeably with the term "where." As used herein, "exemplary" indicates an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

As used herein, "generating," "calculating," "using," "selecting," "accessing," and "determining" are interchangeable unless context indicates otherwise. For example, "generating," "calculating," or "determining" a parameter (or a signal) can refer to actively generating, calculating, or determining the parameter (or the signal) or can refer to using, selecting, or accessing the parameter (or signal) that is already generated, such as by another component or device. As used herein, "coupled" can include "communicatively coupled," "electrically coupled," or "physically coupled," and can also (or alternatively) include any combinations thereof. Two devices (or components) can be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled can be included in the same device or in different devices and can be connected via electronics, one or more connectors, or inductive coupling, as illustrative, non-limiting examples. In some implementations, two devices (or components) that are communicatively coupled, such as in electrical communication, can send and receive electrical signals (digital signals or analog signals) directly or indirectly, such as via one or more wires, buses, networks, etc. As used herein, "directly coupled" is used to describe two devices that are coupled (e.g., communicatively coupled, electrically coupled, or physically coupled) without intervening components.

In addition, implementations presented in this disclosure generally relate to apparatus, systems, and methods for handling fabrics, such as textiles, such as sheet materials, such as leather, cloth, and the like, in the manufacture of items. Some examples of such items include, but are not limited to, garments (e.g. shirts, pants, socks, shoes, shorts, coats, jackets, skirts, dresses, underwear, hats, headbands, and the like), accessories (e.g. wallets, purses, and the like), technical textiles (e.g., for automotive applications, such as seats, interior, and the like), medical textiles (e.g., implants), geotextiles (e.g., reinforcement of embankments), agrotextiles (e.g., textiles for crop protection), boating industry textiles (e.g., sails, interiors and the like) and protective clothing (e.g., heat and radiation protection for fire fighter clothing, molten metal protection for welders, stab protection and bulletproof vests, and spacesuits), and homewares (e.g., artwork, upholstery, towels, bed linens, blankets, mats, and the like).

Some fabrics (so-called "single-faced fabrics") may include a "right side" designated to be on show in the finished item, and a "wrong side" designated to be hidden in the finished item. When such fabrics include a printed design, typically the print is applied to the right side. Additionally, when such fabrics are joined, typically the join is made right side to right side, then the joined fabrics are reversed (for example by turning inside out) such that excess fabric at the join is hidden, and the right sides become facing outwards from each other. Some other fabrics (so-called "double-faced fabrics") are created with two right sides and no wrong sides. Such fabrics are constructed such that either of the two right sides can be designated to be on show in the finished item. Each system and method of the present disclosure includes the performance of manufacturing operations on fabric items that may be right side facing upwards or wrong side facing upwards. In some implementations, a manufacturing operation may be performed on a fabric item that is oriented on the right side facing upwards. In some implementations, a manufacturing operation may be performed on a fabric item that is oriented wrong side facing upwards.

In some implementations of the systems of the present disclosure, fabric items may be transported to a sequence of stations (e.g., from a folding station to a curing station). In some such implementations, a conveyor transports individual fabric items between stations. In some implementations, a robot transports individual fabric items between stations. In some implementations, a robot transports individual fabric items between stations while the individual fabric items are secured in one or more frames. For example, the robot may pick up a rotary storage device and move the rotary storage device between stations. At each station one or more operations are performed in the manufacture of a fabric item. The operations are performed on a work surface, such as a folding table, cutting table, printing table, and the like.

FIG. 1A illustrates an example rotary storage device 102 in a first state 100, in accordance with some examples of the subject disclosure. In some implementations, the rotary storage device 102 includes a body 106, a transfer material 108 coupled to the body 106 at a first end 112 of the transfer material 108, and a plurality of manufactured items 104 disposed in a singulated manner along a transfer material length 110. Each of the manufactured items 104 is removable from the transfer material 108.

The transfer material 108 includes the first end 112 coupled to the body 106, as well as a second end 114 opposite the first end 112. The transfer material 108 includes the transfer material length 110 between the first end 112 and the second end 114. The transfer material length 110 is wound around the body 106 for an entirety of the transfer material length 110. In some aspects, the body 106 can be formed partially or completely of a relatively rigid material capable of supporting the transfer material 108 during storage of the manufactured items 104 as well as subsequent manufacturing processes related to the manufactured items 104. For example, the body 106 can be formed of metal, plastic, cardboard, etc., or some combination thereof. In the same or alternative aspects, the transfer material 108 can be formed partially or completely of a relatively flexible material capable of supporting the manufactured items 104 during storage as well as subsequent manufacturing processes. For example, the transfer material 108 can be formed of fabric, paper, plastic, etc., or some combination thereof. The transfer material 108 can also be formed of a porous material, a non-porous material, adhesive material, non-adhesive material, or some combination thereof. For example, a portion of the transfer material 108 can formed of an adhesive material to hold in place the plurality of manufactured items 104.

The plurality of manufactured items 104 can include one or more components used in the manufacture of fabrics, such as textiles, such as sheet materials, such as leather, cloth, and the like. The plurality of manufactured items 104 can include one or more of the same manufactured items 104, a plurality of different types of manufactured items 104, or some combination thereof. Additionally, the plurality of manufactured items 104 can be of the same size, different sizes, or a combination thereof.

For the purposes of the subject disclosure, "singulated" refers to a manufactured item 104 that has been substantially or completely separated from other manufactured items 104. For example, in certain traditional fabric and/or clothing storage devices, a portion of fabric intended for the use in a manufactured article can be stored wound around a central body. The portion of fabric may or may not be cut to define one or more components of the manufactured article. However, according to the subject disclosure, a singulated manufactured item 104 has been substantially or completely removed from any surrounding material such that the manufactured item 104 is separated from other manufactured items 104. In a particular aspect, the plurality of manufactured items 104 includes a plurality of pre-cut clothing manufactured items. For example, the plurality of manufactured items 104 can include a shirt, shirt component (e.g., pocket, front half of a shirt, back half of a shirt, collar, etc.).

In some implementations, the rotary storage device 102 is configured to support each of the plurality of manufactured items 104 during a subsequent manufacturing operation. The subsequent manufacturing operation can include one or more operations subsequent to the manufacturing of the manufactured items 104. For example, the subsequent manufacturing operation(s) can include folding the manufactured item(s) 104, coupling the manufactured item(s) 104 to one or more other manufactured item(s) 104, etc. In a particular example, the subsequent manufacturing operation includes an item marking operation. The item marking operation can include marking the manufactured item(s) 104 for incorporation into a final manufacturing project (e.g., labeling), tracking in subsequent processing (e.g., applying a laser-readable label for tracking by subsequent processing components), etc. The rotary storage device 102 can be configured to support each of the plurality of pre-cut clothing manufactured items during subsequent manufacturing operation(s).

Figure 1B:
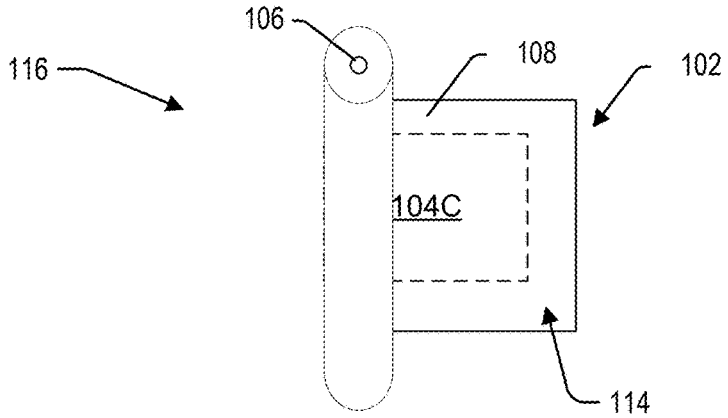
FIG. 1B illustrates the example rotary storage device in a second state, in accordance with some examples of the subject disclosure.

FIG. 1B illustrates the example rotary storage device 102 in a second state 116, in accordance with some examples of the subject disclosure. In the second state 116, the transfer material 108 has been wound around the body 106 of the rotary storage device 102 for a greater portion of the transfer material length 110 than was illustrated in the first state 100. In the second state 116, the body 106 coupled to the first end 112 of the transfer material 108 has been wound further along the transfer material length 110 approaching the second end 114 of the transfer material 108. Once the transfer material 108 has been wound around the body 106 for substantially or completely the transfer material length 110, the rotary storage device 102 can be moved from one location to another location for storage, transportation, further processing, etc. For example, a manufacturer can store a plurality of rotary storage devices 102 in a storage space for storage prior to further manufacturing, distribution, etc.

Figure 1C:
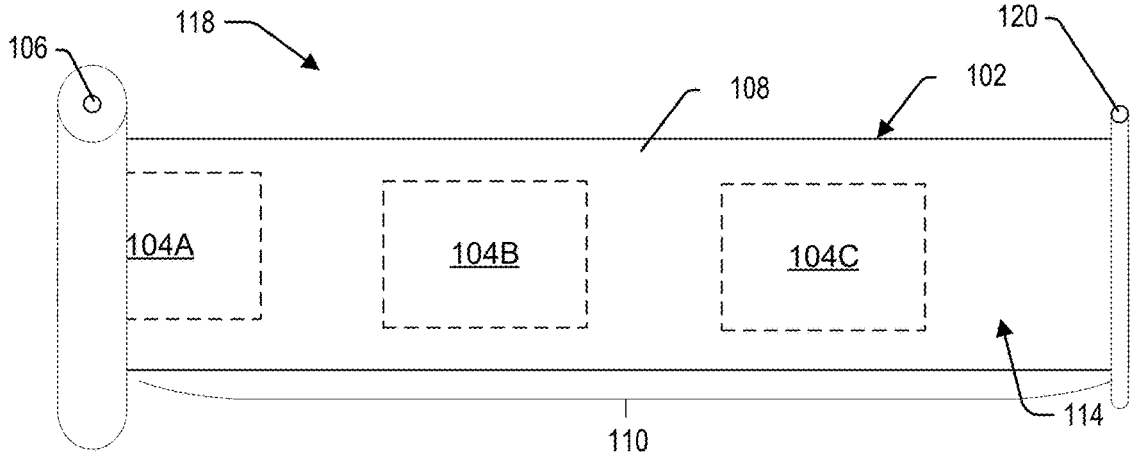
FIG. 1C illustrates the example rotary storage device in a third state, in accordance with some examples of the subject disclosure.

As another example, the rotary storage device 102 can be used to support the transfer material 108 and/or the manufactured item(s) 104 for a subsequent manufactured item. FIG. 1C illustrates the example rotary storage device 102 in a third state 118, in accordance with some examples of the subject disclosure. In the third state 118, the second end 114 of the transfer material 108 has been coupled to a second body 120. The transfer material length 110 can be configured to be wound around the second body 120 for the entirety as the plurality of manufactured items 104 are removed from the rotary storage device 102.

Figure 1D:
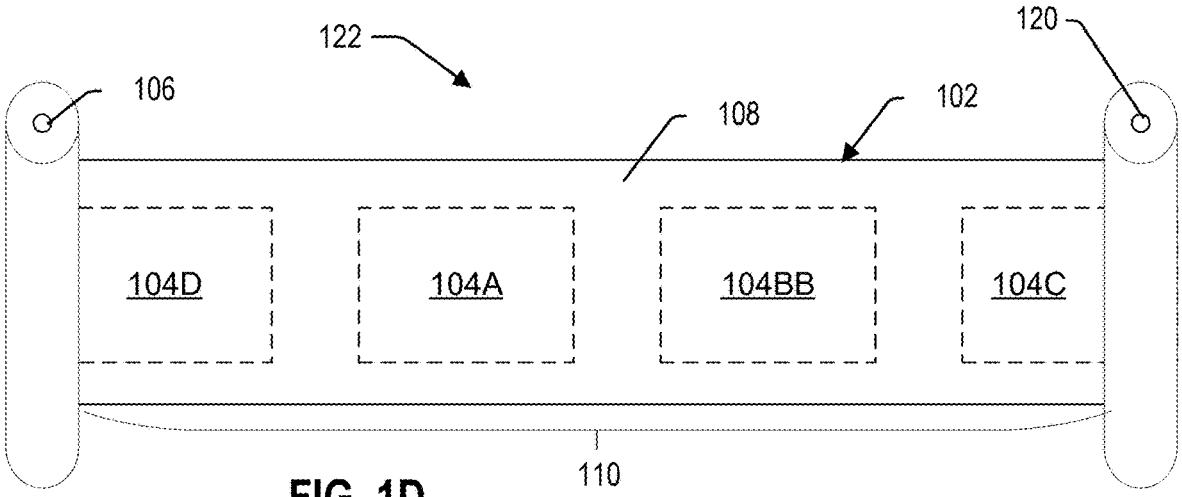
FIG. 1D illustrates the example rotary storage device in a fourth state, in accordance with some examples of the subject disclosure.

FIG. 1D illustrates the example rotary storage device 102 in a fourth state 122, in accordance with some examples of the subject disclosure. In the fourth state 122, the second end 114 (not illustrated) of the transfer material 108 has been wound around the second body 120 for a greater portion of the transfer material length 110 than was illustrated in the third state 118. As illustrated in FIG. 1D, the third manufactured item 104C has approached closer to the second body 120, and the fourth manufactured item 104D has been presented in a singulated manner along the transfer material 108 away from the first body 106.

Figure 1E:
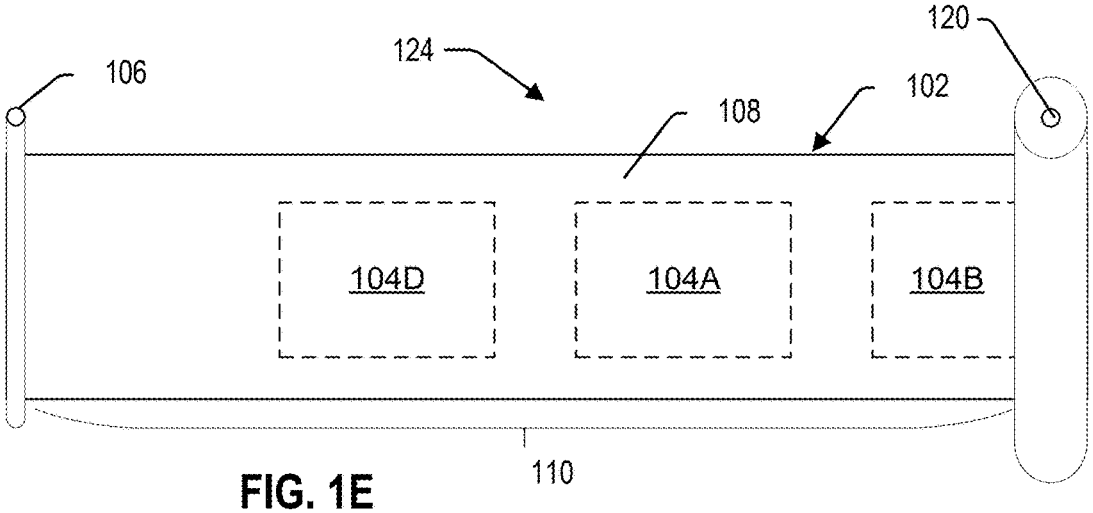
FIG. 1E illustrates the example rotary storage device in a fifth state, in accordance with some examples of the subject disclosure.

FIG. 1E illustrates the example rotary storage device 102 in a fifth state 124, in accordance with some examples of the subject disclosure. In the fifth state 124, the second end 114 (not illustrated) of the transfer material 108 has been wound around the second body 120 for a greater portion of the transfer material length 110 than was illustrated in the fourth state 122. In the fifth state 124, the transfer material 108 has been wound around the second body 120 for a substantial portion of the entirety of the transfer material length 110. As illustrated in FIG. 1E, the third manufactured item 104C (not illustrated) has been wound around the second body 120, the second manufactured item 104B has approach closer to the second body 120, and the fourth manufactured item 104D has approached closer to the second body 120.

Figure 1F:
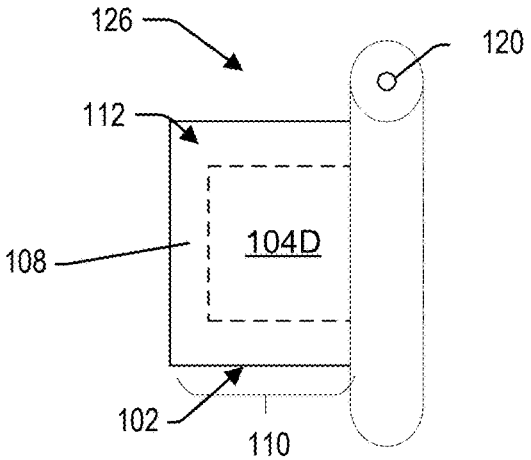
FIG. 1F illustrates the example rotary storage device in a sixth state, in accordance with some examples of the subject disclosure.

FIG. 1F illustrates the example rotary storage device 102 in a sixth state 126, in accordance with some examples of the subject disclosure. In the sixth state 126, the transfer material 108 has been wound around the second body 120 for substantially the entirety of the transfer material length 110. In the sixth state 126, the first, second, and third manufactured items 104A, 104B, 104C have been wound around the second body 120, and the first end 112 has separated from the first body 106 (not illustrated) so that the entirety of the transfer material length 110 can be wound around the second body 120 for storage, transportation, distribution, etc.

In operation, the transfer material 108 can be spooled and/or unspooled an entirety of the transfer material length 110, with a plurality of singulated manufactured items 104 disposed along the transfer material length 110. A first end 112 of the transfer material 108 can be configured to be coupled to a first body 106, and a second end 114 can be configured to be coupled to a second body 120. For storage, transportation, distribution, etc., the rotary storage device 102 can have the transfer material 108 wound around the first body 106 for an entirety of the transfer material length 110. To support the manufactured items 104, the rotary storage device 102 can unspool the transfer material 108 to be re-spooled around the second body 120 (e.g., as the rotary storage device 102 moves from the state 116 through the states 118, 122, 124, 16). Disposed between the first body 106 and the second body 120, subsequent manufacturing processes can take place. For example, a vacuum table can temporarily hold in place a portion of the transfer material 108 associated with a particular manufactured item 104 while the particular manufactured item 104 is removed (e.g., by an articulated robotic arm) to be moved to a different processing station. The partially or completely empty transfer material 108, now wound around the second body 120 for the entirety of the transfer material length 110, is ready for receipt of additional manufactured items 104 for storage as part of a rotary storage system.

In some implementations, the rotary storage device 102 is configured to support each of the plurality of manufactured items 104 during a subsequent manufacturing operation. FIG. 2 illustrates an example system 200 including the rotary storage device 102 of FIGS. 1A-1F supporting manufactured items 204 (including a first manufactured item 204A, a second manufactured item 204B, and a third manufactured item 204C) during a subsequent manufacturing operation, in accordance with some examples of the subject disclosure. As noted above, a subsequent manufacturing operation can include a combination of manufactured items 204 into a more complex manufactured item, transfer of a particular manufactured item 204 to another portion of a manufacturing system for further processing, an item marking process, etc. In the illustrated example of FIG. 2, the manufactured items 204 are fabric components (e.g., a front portion, back portion, etc.) for use in subsequent manufacturing processes to form a final fabric item.

In some implementations, the system 200 includes the rotary storage device 102 of FIG. 1 coupled to one or more rotary storage system couplers 208 at a first end and one or more rotary storage system couplers 208 at a second end opposite the first end. The one or more rotary storage system couplers 208 are configured to secure an end of the rotary storage device 102 such that the rotary storage device 102 is substantially immobile while the manufactured items 204 are processed. The rotary storage system coupler(s) 208 can include, for example, a clip, tab, lock etc. configured to receive the first body 106 and/or the second body 120 during a subsequent manufacturing process.

The system 200 can also include one or more motors 202 configured to rotate the first body 106 and/or the second body 120 such that the transfer material 108 of the rotary storage device 102 can unspool from the first body 106 and spool around the second body 120. In some aspects, the motor(s) 202 can include one or more stepper motors. In configurations in which a stepper motor is coupled to the first body 106 and the second body 120, for example, one stepper can be active to spool the transfer material 110 on one side while the other stepper is configured to passively resist.

In some implementations, the spooling and/or unspooling of the transfer material 108 can be automated, manual, or some combination thereof. For example, the system 200 can include one or more sensors configured to identify when a particular manufactured item 204 has been processed and the system is ready to process another particular manufactured item 204. The system 200 can be configured to spool the transfer material 110 so that the new manufactured item 204 is presented for subsequent processing. As another example, the system 200 can include one or more switches so that an operator of the system 200 can manually cause the spooling and/or unspooling of the transfer material 108.

In a particular implementation, the transfer material 108 is configured to be supported by a manufactured item support surface 210 for singulated processing of the manufactured item(s) 204. For example, a subsequent manufacturing process can include transferring individual, singulated manufactured item(s) 204 from the transfer material 108 to another portion of the system 200 (or to another system) for additional manufacturing operations. In some aspects, as illustrated in FIG. 2, the manufactured item support surface 210 can include a vacuum table surface. The vacuum table surface can include a plurality of perforations 228, allowing the vacuum table surface to temporarily hold a portion of the transfer material 108 associated with a particular manufactured item (e.g., the manufactured item 204B of FIG. 2). The vacuum table surface can also include one or more vacuum assemblies configured to provide the vacuum used to temporarily hold the portion of the transfer material 108 associated with the particular manufactured item 204. While the portion of the transfer material 108 is temporarily held, another portion of the system 200 (e.g., an articulated robotic arm) can be configured to remove the particular manufactured item 104 from the transfer material 108 and move the particular manufactured item 204 to another portion of the system 200 (or another system) for further manufacturing processes (e.g., to an item marking surface, folding surface, cutting surface, adhering surface, etc.).

In some implementations, the system 200 can also include one or more rollers 206 configured to hold a portion of the transfer material 108 taught while the manufactured items 204 are processed. The roller(s) 206 can be configured to raise and/or lower as subsequent manufactured items 204 are moved across the manufactured item support surface 210. The roller(s) 206 can also be configured to remain substantially in place while the transfer material 108 is spool and/or unspooled beneath the roller(s) 206.

In some implementations, the system 200 can also include one or more controllers configured to control one or more portions of the subsequent manufacturing processes for the manufactured items 204. The controller(s) can include one or more microprocessors, microcontrollers, etc. configured to control one or more components of the system 200. For example, the controller(s) can be configured to control the spooling and/or unspooling of the transfer material 108 about the first body 106 and/or the second body 120. As another example, the controller(s) can be configured to control the manufactured item support surface 210 (e.g., controlling the vacuum assemblies of a vacuum table). As a further example, the controller(s) can be configured to control a vision system used to identify a particular manufactured item 204, perform an indexing function on the manufactured items 204, etc.

In some implementations, the system 200 can also include one or more processing apparatus 220. The processing apparatus 220 can include an articulated arm 222 attached to a gripper 224. The gripper 224 may be manipulated by the articulated arm 222 to perform operations on the fabric item. For example, the gripper 224 may be configured to retrieve and/or place a particular manufactured item 204. The processing apparatus 220 can further include an alignment sensor 226. The alignment sensor 226 may be configured to generate sensor data indicating a position of the particular manufactured item 204 relative to an associated portion of the transfer material. In some aspects, the processing apparatus 220 can include, or be included within, a robot. The robot can be configured to move fabric items onto, and remove fabric items from, the transfer material 108. In some implementations, the robot may be mounted on a gantry above the system 200. In other implementations, the robot may be freestanding. The robot may include an articulated arm attached to a head that may selectively hold and release the fabric item. In some implementations, the head may include clamps or other grippers that may selectively hold or release the fabric item. In other implementations, the head may include an electrostatic plate to selectively hold or release the fabric item. In some implementations, the head may include a vacuum assembly, such as a perforated plate coupled to a vacuum pump, to selectively hold or release the fabric item.

In some aspects, the processing apparatus 220 and/or the robot can include one or more sensors that can be used to assist with subsequent manufacturing operations of the manufactured items 204. For example, the sensor may include a camera. For instance, the camera may capture an image of the fabric item and relay the image to a controller. The controller can determine a position, orientation, and/or extent of the particular manufactured item 204. The controller can direct the head to the fabric item according to the determined position, orientation, and/or extent of the particular manufactured item 204. In some implementations, the controller can use images captured by the one or more cameras in controlling operation of any component of the system 200. For example, the controller can use images captured by the one or more cameras to control spooling and/or unspooling of the transfer material 108. In a particular configuration, the controller can use images captured by the one or more cameras to perform an indexing operation for the manufactured items 204.

In some implementations, the system 200 can also include one or more additional components to aid in automated processing operations. For example, the system 200 can include one or more rotary encoders to measure motion of the transfer material 108 through the system 200. The rotary encoders can be used, for example, to ensure that the transfer material 108 does not move through the system 200 at a speed that would be determinantal to the transfer material 108, the manufactured item(s) 204, other components of the system 200, or a combination thereof.

The system 200 can also include one or more part sensors configured to determine when a particular manufactured item 204 is present for processing (e.g., the portion of the transfer material 108 associated with the particular manufactured item 204 is centered on a relevant portion of the manufactured item support surface 210). In some aspects, the part sensor(s) can include a light sensor configured to determine when a light reflective value associated with the relevant portion of the manufactured item support surface 210 changes beyond a threshold value. The light change can indicate that a new particular manufactured item 204 is present for processing. In some configurations, the part sensor(s) can be integrated into the manufactured item support surface 210, the rotary storage device 102, one or more other components of the system 200, or a combination thereof.

The system 200 can also include one or more belt-end sensors configured to determine when the rotary storage device 102 is empty (e.g., when the entirety of the transfer material length 110 of FIG. 1 has substantially and/or completely unspooled from the first body 106). In some aspects, the belt-end sensor(s) can be integrated into one or more of the storage system couplers 208, the rotary storage device 102 itself, one or more other components of the system 200, or a combination thereof.

In operation, a portion of the transfer material length 110 of FIG. 1 is wound around the first body 106 and the second end 114 of the transfer material is coupled to the second body 120. A plurality of manufactured items 204 are disposed along the transfer material length 110 in a singulated manner. The rotary storage system couplers 208 are configured to hold the first body 106 and the second body 120 while the manufactured items 204 are subject to a subsequent manufacturing process. For example, as illustrated in FIG. 2, the second manufactured item 204B is supported by the manufactured item support surface 210, which in the illustrated example is a vacuum table. The perforations 228 of the vacuum table enable the vacuum assemblies to temporarily hold the second manufactured item in place. The rollers 206 disposed on either side of the second manufactured item 204B hold the transfer material taught during processing of the second manufactured item 204B. The processing of the second manufactured item 204B can include marking, indexing, removal, placement, additional manufacturing, etc. In the example of FIG. 2, the second manufactured item 204B is removed from the transfer material 108 (e.g., by the processing apparatus 220) when one or more sensors indicate that the second manufactured item 204B is appropriately positioned for removal.

Once the second manufactured item 204B has been processed, the controller(s) of the system 200 can be configured to spool the transfer material 108 around the second body 120 and/or unspool the transfer material 108 from the first body 106 so that the first manufactured item 204A can be positioned for processing. As noted above, the spooling and/or unspooling can be performed by a winding system of the system 200 (e.g., the stepper motor(s)). In the example of FIG. 2, the first manufactured item 204A is positioned to be processed next, and the third manufactured item 204C has already been removed.

Figure 3:
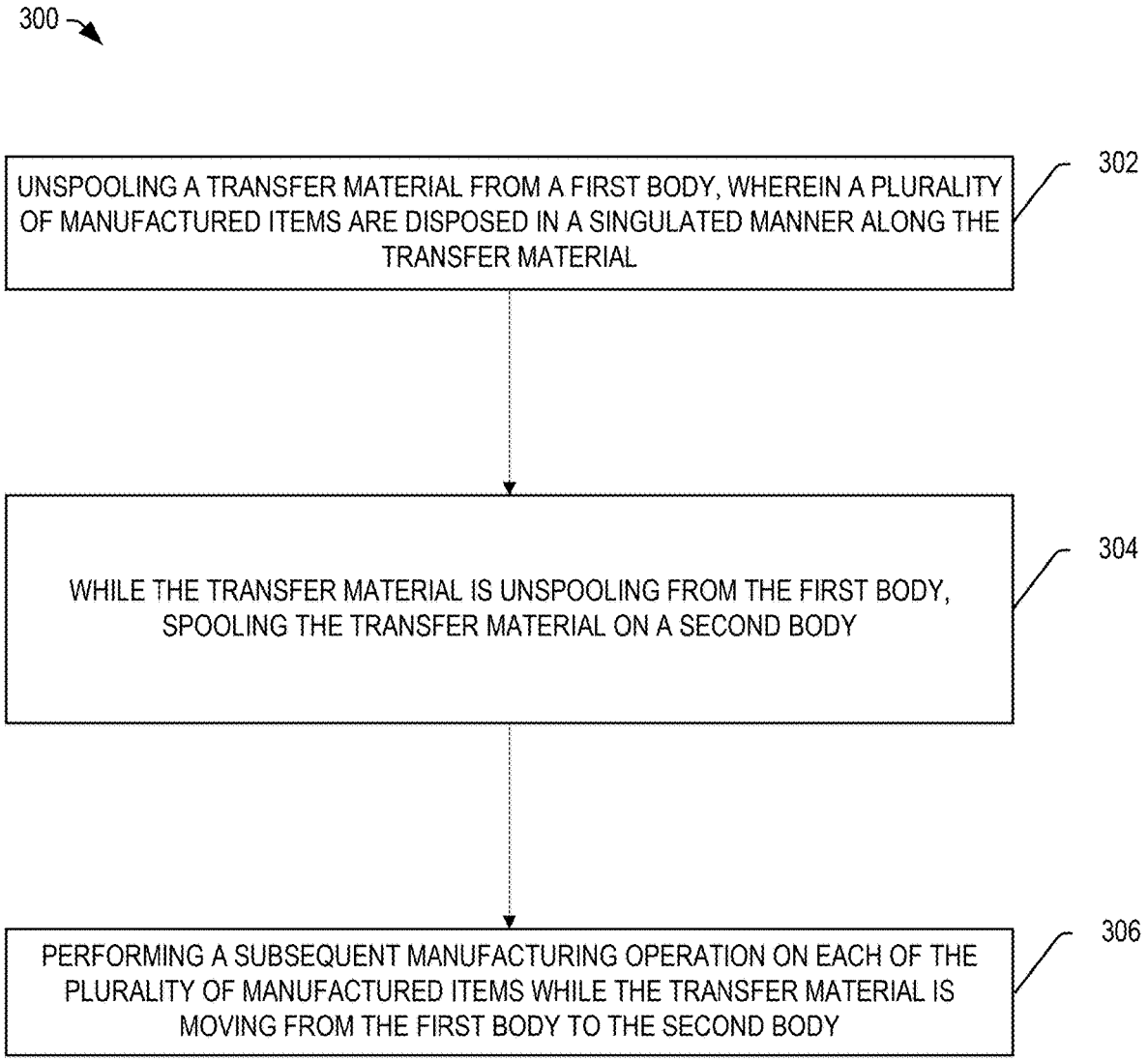
FIG. 3 illustrates a flow chart of an example method for rotary storage of manufactured items, in accordance with some examples of the subject disclosure.

FIG. 3 illustrates a flow chart of an example method 300 for rotary storage of manufactured items, in accordance with some examples of the subject disclosure. The method 300 can be performed by a rotary storage system, such as the rotary storage system 200 of FIG. 2.

The method 300 includes, at block 302, unspooling a transfer material from a first body, wherein a plurality of manufactured items are disposed in a singulated manner along the transfer material. For example, a first rotary storage system coupler 208 and/or a first motor 202 of FIG. 2 can be configured to unspool the transfer material 108 from the first body 106. The manufactured items 104 are disposed in a singulated manner along the transfer material 108.

The method 300 also includes, at block 304, while the transfer material is unspooling from the first body, spooling the transfer material on a second body. For example, a second rotary storage system coupler 208 and/or a second motor 202 of FIG. 2 can be configured to, while the transfer material 108 is unspooling from the first body 106, spooling the transfer material 108 on the second body 120.

The method 300 also include, at block 306, performing a subsequent manufacturing operation on each of the plurality of manufactured items while the transfer material is moving from the first body to the second body. For example, the system 200 of FIG. 2 can perform an item marking operation on each of the manufactured items 104 while the transfer material 108 is moving from the first body 106 to the second body 120.

Although FIG. 3 illustrates the method 300 and includes the blocks 302-306, additional and/or different blocks can be included without departing from the scope of the subject disclosure. For example, the method 300 can also include performing the subsequent manufacturing operation occurs while a portion of the transfer material containing a particular manufactured item that is subject to the subsequent manufacturing process is supported by a manufactured item support surface.

By using the techniques and systems described herein, the manufacturing efficiency for manufacturing the fabric item may increase because multiple manufactured items that are components for manufacturing a fabric item can be stored in a singulated manner for storage, transportation, distribution, etc., and for use in one or more additional, subsequent manufacturing processes. Storage in a singulated manner allows for the singulated removal of each manufactured item for subsequent manufacturing. Storage as a rotary storage device can enable the integration of the rotary storage device itself into a subsequent manufacturing process.

Particular aspects of the disclosure are described below in sets of interrelated Examples:

According to Example 1, a rotary storage device includes a body, a transfer material includes a first end coupled to the body, a second end opposite the first end, and a transfer material length between the first end and the second end. The transfer material length is wound around the body for an entirety of the transfer material length. The rotary storage device also includes a plurality of manufactured items disposed in a singulated manner along the transfer material length. Each of the plurality of manufactured items is removable from the transfer material.

Example 2 includes the rotary storage device of Example 1, wherein the rotary storage device is configured to support each of the plurality of manufactured items during a subsequent manufacturing operation.

Example 3 includes the rotary storage device of Example 1 or Example 2, wherein the subsequent manufacturing operation comprises an item marking operation.

Example 4 includes the rotary storage device of any of Examples 1 to 3, wherein the plurality of manufactured items comprises a plurality of pre-cut clothing manufactured items.

Example 5 includes the rotary storage device of Example 4, wherein the rotary storage device is configured to support each of the plurality of manufactured items during a subsequent manufacturing operation.

Example 6 includes the rotary storage device of any of Examples 1 to 5, wherein the second end is configured to couple to a second body; and the transfer material length is configured to be wound around the second body for the entirety as the plurality of manufactured items are removed from the rotary storage device.

Example 7 includes the rotary storage device of any of Examples 1 to 6, wherein the transfer material is configured to be supported by a manufactured item support surface for singulated removal of the manufactured items from the transfer material.

Example 8 includes the rotary storage device of Example 7, wherein the manufactured item support surface comprises a vacuum table surface.

According to Example 9, a system includes a rotary storage device includes a first body; a transfer material includes a first end configured to be coupled to the first body; a second end opposite the first end and configured to be coupled to a second body; a transfer material length between the first end and the second end; and a plurality of manufactured items disposed in a singulated manner along the transfer material length, wherein each of the plurality of manufactured items is removable from the transfer material; and a manufactured item support surface disposed between the first and second bodies, wherein the manufactured item support surface is configured to support each of the plurality of manufactured items during singulated removal of the plurality of manufactured items from the transfer material.

Example 10 includes the system of Example 9, wherein the manufactured item support surface comprises a vacuum table surface.

Example 11 includes the system of Example 9 or Example 10, wherein the manufactured item support surface is further configured to support each of the plurality of manufactured items during a subsequent manufacturing operation.

Example 12 includes the system of Example 11, wherein the subsequent manufacturing operation comprises an item marking operation.

Example 13 includes the system of any of Examples 9 to 12, wherein the plurality of manufactured items comprises a plurality of pre-cut clothing manufactured items.

Example 14 includes the system of any of Examples 9 to 13, wherein: the transfer material length is wound around the first body in a first manufacturing operation state; the transfer material length is wound around the second body in a second manufacturing operation state; and the system further comprises a winding system coupled to the first and second bodies, the winding system configured to rotate the first and second bodies while the system moves from the first manufacturing operation state to the second manufacturing operation state.

Example 15 includes the rotary storage device of Example 14, wherein the transfer material length moves along the manufactured item support surface while the system moves from the first manufacturing operation state to the second manufacturing operation state.

According to Example 16, a method includes unspooling a transfer material from a first body, wherein a plurality of manufactured items are disposed in a singulated manner along the transfer material; while the transfer material is unspooling from the first body, spooling the transfer material on a second body; and performing a subsequent manufacturing operation on each of the plurality of manufactured items while the transfer material is moving from the first body to the second body.

Example 17 includes the method of Example 16, wherein the subsequent manufacturing operation comprises an item removal operation.

Example 18 includes the method of Example 16 or Example 17, wherein the plurality of manufactured items comprises a plurality of pre-cut clothing manufactured items.

Example 19 includes the method of Example 18, wherein the subsequent manufacturing operation comprises an item marking operation.

Example 20 includes the method of any of Examples 16 to 19, wherein the subsequent manufacturing operation occurs while a portion of the transfer material containing a particular manufactured item that is subject to the subsequent manufacturing process is supported by a manufactured item support surface.

Example 21 includes the method of Example 20, wherein the manufactured item support surface comprises a vacuum table surface.

The illustrations of the examples described herein are intended to provide a general understanding of the structure of the various implementations. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate but do not limit the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. A rotary storage device comprising:
a body;
a transfer material comprising:
a first end coupled to the body;
a second end opposite the first end; and
a transfer material length between the first end and the second end, wherein the transfer material length is wound around the body for an entirety of the transfer material length to form a storage state for storage, transportation, or distribution of a plurality of manufactured items; and
the plurality of manufactured items disposed in a singulated manner along the transfer material length, wherein each manufactured item of the plurality of manufactured items is removable from the transfer material, and wherein the plurality of manufactured items comprises one or more fabric items, one or more fabric item components, or both the one or more fabric items and the one or more fabric item components.

2. The rotary storage device of claim 1, wherein the rotary storage device is configured to support each of the plurality of manufactured items during a subsequent manufacturing operation.

3. The rotary storage device of claim 1, wherein the transfer material length is formed of a non-adhesive material.

4. The rotary storage device of claim 1, wherein the plurality of manufactured items comprises the one or more fabric item components, wherein a first fabric clothing item component of the one or more fabric item components comprises a front of a first fabric clothing item, and wherein a second fabric item clothing component of the one of more fabric item components comprises a back of the first fabric clothing item.

5. The rotary storage device of claim 4, wherein the rotary storage device is configured to support each of the plurality of manufactured items during a subsequent manufacturing operation that combines the first fabric item clothing component to the second fabric item clothing component to form the first fabric clothing item.

6. The rotary storage device of claim 1, wherein:
the second end is configured to couple to a second body; and
the transfer material length is configured to be wound around the second body for the entirety as the plurality of manufactured items are removed from the rotary storage device.

7. The rotary storage device of claim 1, wherein the transfer material is configured to be unwound from the body and supported by a manufactured item support surface for singulated removal of the manufactured items from the transfer material.

8. The rotary storage device of claim 7, wherein the manufactured item support surface comprises a vacuum table surface.

9. A system comprising:
a rotary storage device comprising a first body;
a second body;
a transfer material comprising:
a first end configured to be coupled to the first body;
a second end opposite the first end and configured to be coupled to the second body;
a transfer material length between the first end and the second end, wherein the transfer material length is wound around the first body for an entirety of the transfer material length to form a storage state for storage, transportation, or distribution of a plurality of manufactured items, and wherein the transfer material length is configured to be unwound from the first body and wound around the second body; and
the plurality of manufactured items disposed in a singulated manner along the transfer material length, wherein each manufactured item of the plurality of manufactured items is removable from the transfer material, and wherein the plurality of manufactured items comprises one or more fabric items, one or more fabric item components, or both the one or more fabric items and the one or more fabric item components; and
a manufactured item support surface disposed between the first and second bodies, wherein the manufactured item support surface is configured to support each of the plurality of manufactured items during singulated removal of the plurality of manufactured items from an unwound portion of the transfer material.

10. The system of claim 9, wherein the manufactured item support surface comprises a vacuum table surface.

11. The system of claim 9, further comprising one or more controllers configured to control a subsequent manufacturing operation, wherein the manufactured item support surface is further configured to support each of the plurality of manufactured items during the subsequent manufacturing operation.

12. The system of claim 11, wherein the subsequent manufacturing operation comprises an adhesive application operation, and wherein the controllers are configured to control the adhesive application operation.

13. The system of claim 11, wherein the subsequent manufacturing operation comprises an adhesive curing operation, and wherein the controllers are configured to control the adhesive curing operation.

14. The system of claim 11, wherein the subsequent manufacturing operation comprises an item marking operation, and wherein the controllers are configured to control the item marking operation.

15. The system of claim 14, wherein the item marking operation comprises an item labeling operation, and wherein the controllers are configured to control the item labeling operation.

16. The system of claim 14, wherein the item marking operation comprises an item tracking operation, and wherein the controllers are configured to control the item tracking operation.

17. The system of claim 9, wherein the plurality of manufactured items comprises a plurality of pre-cut clothing manufactured items.

18. The system of claim 17, wherein at least one of the plurality of pre-cut clothing manufactured items comprises a shirt component.

19. The system of claim 9, wherein:

the system further comprises a winding system coupled to the first and second bodies, the winding system configured to rotate the first and second bodies while the system moves from a first manufacturing operation state to a second manufacturing operation state.

20. The rotary storage device of claim 19, wherein the transfer material length moves along the manufactured item support surface while the system moves from the first manufacturing operation state to the second manufacturing operation state.

* * * * *